US006554204B1

(12) United States Patent
Nguyen et al.

(10) Patent No.: US 6,554,204 B1
(45) Date of Patent: Apr. 29, 2003

(54) INTEGRATED GUN FLUSH CONTROLLER

(75) Inventors: Vu K. Nguyen, Brooklyn Park, MN (US); Lawrence P. Jeutter, Minneapolis, MN (US); Dennis J. Van Keulen, Rogers, MN (US)

(73) Assignee: Graco Inc., Minneapolis, MN (US)

( * ) Notice: Subject to any disclaimer, the term of this patent is extended or adjusted under 35 U.S.C. 154(b) by 0 days.

(21) Appl. No.: 09/691,916

(22) Filed: Oct. 8, 1999

Related U.S. Application Data

(60) Provisional application No. 60/158,452, filed on Oct. 8, 1999.

(51) Int. Cl.[7] ..... B05B 15/02

(52) U.S. Cl. ..... 239/112; 239/120; 239/71; 239/304

(58) Field of Search ..... 239/67, 71, 104, 239/106, 112, 120, 304, 305; 222/148, 183; 137/237, 238, 240

(56) References Cited

U.S. PATENT DOCUMENTS

| | | | | | |
|---|---|---|---|---|---|
| 3,672,570 | A | * | 6/1972 | Scarbrough et al. | 239/112 |
| 3,674,205 | A | * | 7/1972 | Kock | 137/240 |
| 3,857,513 | A | * | 12/1974 | Wiggins | 239/112 |
| 4,019,653 | A | * | 4/1977 | Scherer et al. | 239/71 |
| 5,464,283 | A | * | 11/1995 | Davis | 239/71 |

* cited by examiner

*Primary Examiner*—Steven J. Ganey
(74) *Attorney, Agent, or Firm*—Douglas B. Farrow

(57) ABSTRACT

A gun flush box is controlled by a plural component proportioning unit. When a color change is desired, the operator places the spray gun in the flush box. When a new color is selected, the control system automatically triggers the gun and flushes the gun with solvent with the flush material safely routed to a waste container. The control system automatically triggers the gun to refill the lines with new color paint without using excess paint as it displaces the flush solvent. This system is also capable of working with two guns in operation.

1 Claim, 1 Drawing Sheet

INTEGRATED GUN FLUSH CONTROLLER

RELATED APPLICATIONS

Figure 1:
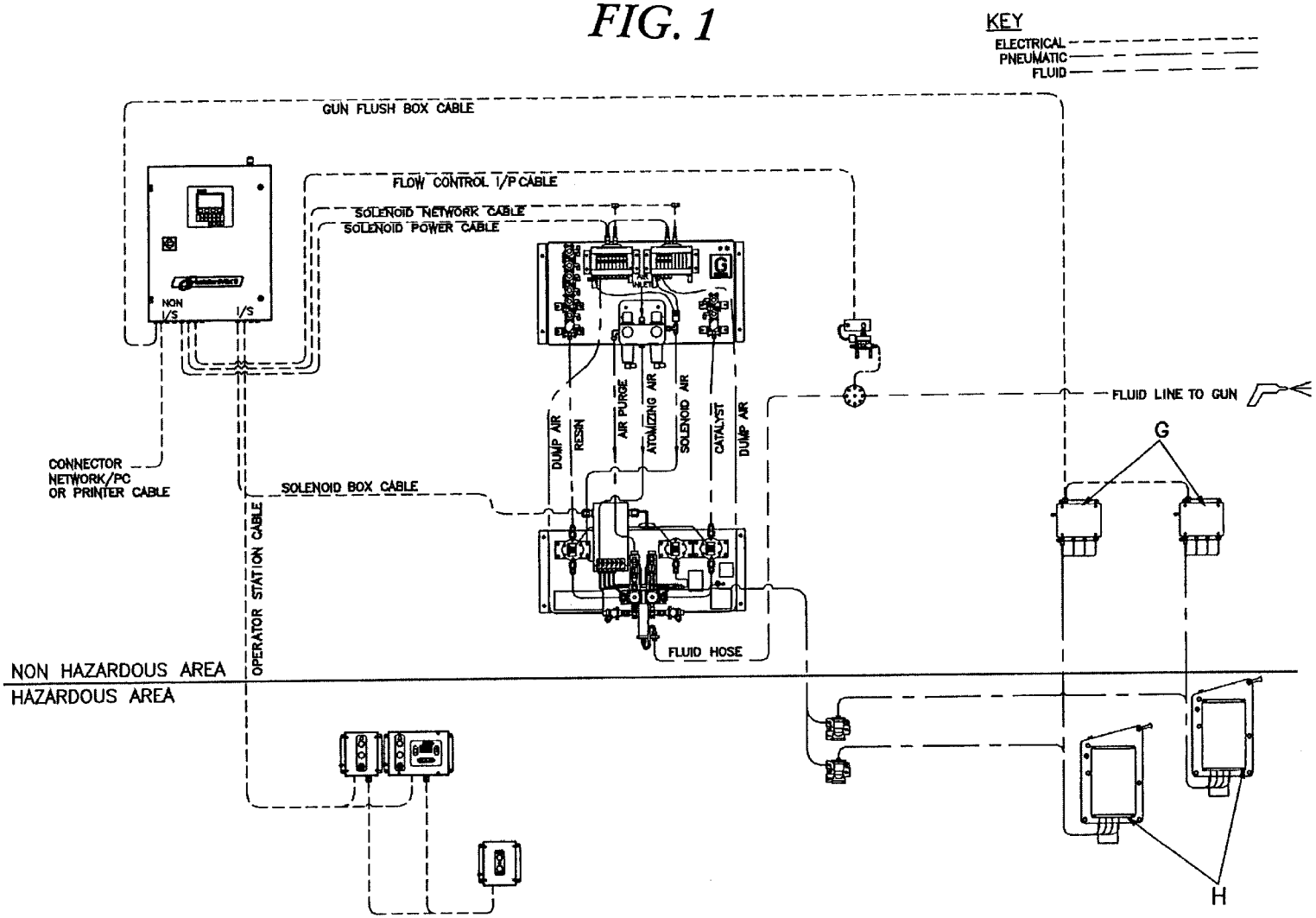

This application is a Conversion of U.S. Provisional Application serial No. 60/158,452, filed Oct. 8, 1999.

BACKGROUND OF THE INVENTION

While gun flush boxes have been known and used for a number of years, such boxes typically have relatively low "intelligence" and require a fair degree of operator knowledge and setup.

SUMMARY OF THE INVENTION

The purpose of this invention is to provide the painter and operator using the plural component proportioner with built-in automated gun flushing capability. The gun flush box of the instant invention is controlled by Graco's PRECISIONMIX® II controller to automatically flush one or two manual guns into a closed waste container. During an automated color change, it automatically flushes the gun and loads the next paint color.

The advantage of using a gun flush box over a conventional flushing methods includes the reduced solvent usage, reduced VOC (volatile organic compounds) emissions and improved operator safety during flushing. The controller flushes the exact amount of solvent required to clean the system and reduces VOCs by preventing solvent from being atomized during the flush cycle. Traditional flushing procedures expose the operator to atomized solvents and accidental gun discharge. The flush box contains the solvent and prevents accidental gun triggering with safety interlocks. Interlocks will only allow atomizing air to the gun when the gun is out of the gun flush box and the door to the box is closed. If a switch fails or if system air is shut off, the atomizing air will be shut off to the gun.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

FIG. 1 is a schematic view of the instant invention

DESCRIPTION OF THE PREFERRED EMBODIMENT

The parts of the invention consist of the gun flush box H, solenoid box G, cable air tubing and an atomizing air safety shut off valve. Control is provided by intelligence already present in the PRECISIONMIX II proportioning controller so that no additional control is needed to perform the automated flush functions.

When a color change is desired, the operator places the spray gun in the flush box. When a new color is selected, the control system automatically triggers the gun and flushes the gun with solvent with the flush material safely routed to a waste container. The control system automatically triggers the gun to refill the lines with new color paint without using excess paint as it displaces the flush solvent. This system is also capable of working with two guns in operation.

When the gun is not used it is placed in the gun flush box. If the control system determines the pot-life of the material in the system has expired, it will alarm and purge the material automatically thereby protecting the system from getting plugged with cured material.

This system may also be used to perform an automated gun flush at the end of the shift or working day simply by placing the gun in the box and initiating a purge at the operators station.

This allows customers to buy one product that will perform both the proportioning and automated gun flush function without having to add on external controllers or PLCs.

The advantages include protection from materials curing in the system which may be very expensive to remedy, reduced solvent usage and VOC emissions, improved operator safety, simpler automated color change and flushing procedures for operators and significantly reduced chance for errors during those procedures.

It is contemplated that various changes and modifications may be made the gun flush controller without departing from the spirit and scope of the invention as defined by the following claims.

What is claimed is:

1. An integrated gun flush controller in a plural component proportioning system for producing a mixed material and having a control unit, first and second sources of material, a mixing unit connected to said sources and said control unit and an application device connected to said mixing unit, the improvement comprising:

a gun flush box connected to said control unit and capable of receiving said application device, said control unit being capable of calculating potlife of mixed material and alarming to require placement of said application device in said gun flush box; and said control unit being responsive to placement of said application device in said gun flush box in order to operate said application device.

* * * * *

(12) INTER PARTES REVIEW CERTIFICATE (108th)

United States Patent
Nguyen et al.

(10) Number: US 6,554,204 K1
(45) Certificate Issued: Jan. 12, 2016

(54) INTEGRATED GUN FLUSH CONTROLLER

(75) Inventors: Vu K. Nguyen; Lawrence P. Jeutter; Dennis J. Van Keulen

(73) Assignee: GRACO MINNESOTA INC.

Trial Number:

IPR2013-00452 filed Jul. 18, 2013

Petitioner: Autoquip, Inc.

Patent Owner: Graco Minnesota, Inc.

Inter Partes Review Certificate for:

Patent No.: 6,554,204
Issued: Apr. 29, 2003
Appl. No.: 09/691,916
Filed: Oct. 8, 1999

The results of IPR2013-00452 are reflected in this inter partes review certificate under 35 U.S.C. 318(b).

INTER PARTES REVIEW CERTIFICATE
U.S. Patent 6,554,204 K1
Trial No. IPR2013-00452
Certificate Issued Jan. 12, 2016

AS A RESULT OF THE INTER PARTES REVIEW PROCEEDING, IT HAS BEEN DETERMINED THAT:

Claim 1 is cancelled.

* * * * *